US007546876B2

(12) United States Patent
McAfee

(10) Patent No.: US 7,546,876 B2
(45) **Date of Patent: *Jun. 16, 2009**

(54) METHOD AND APPARATUS FOR JET-FLUID ABRASIVE CUTTING

(75) Inventor: Wesley Mark McAfee, Montgomery, TX (US)

(73) Assignee: Alberta Energy Partners, Montgomery, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/178,953

(22) Filed: Jul. 24, 2008

(65) Prior Publication Data

US 2008/0277118 A1 Nov. 13, 2008

Related U.S. Application Data

(63) Continuation of application No. 10/592,560, filed as application No. PCT/US2005/041017 on Nov. 14, 2005.

(60) Provisional application No. 60/627,308, filed on Nov. 12, 2004.

(51) Int. Cl.
*E21B 29/06* (2006.01)

(52) U.S. Cl. ..... 166/298; 166/53; 166/55.7; 175/24; 175/25

(58) Field of Classification Search ..... 166/298, 166/55.7, 53, 24; 175/38
See application file for complete search history.

(56) References Cited

U.S. PATENT DOCUMENTS 5,857,530 A * 1/1999 Gronseth ..... 175/45
6,189,629 B1 * 2/2001 McLeod et al. ..... 175/67
6,964,303 B2 * 11/2005 Mazorow et al. ..... 166/298

* cited by examiner

*Primary Examiner*—David J Bagnell
*Assistant Examiner*—Robert E Fuller
(74) *Attorney, Agent, or Firm*—Hulsey IP Intellectual Property Lawyers, P.C.

(57) ABSTRACT

A method and apparatus for down hole abrasive jet-fluid cutting, the apparatus includes a jet-fluid nozzle and a high pressure pump capable of delivering a high-pressure abrasive fluid mixture to the jet-fluid nozzle, an abrasive fluid mixing unit capable of maintaining and providing a coherent abrasive fluid mixture, a tube to deliver the high pressure coherent abrasive mixture down hole to the jet-fluid nozzle, a jetting shoe adapted to receive the jet-fluid nozzle and directing abrasive jet-fluid mixture towards a work piece, a jetting shoe controlling unit that manipulates the jetting shoe along a vertical and horizontal axis and a central processing unit having a memory unit capable of storing profile generation data for cutting a predefined shape or window profile in the work piece and coordinating the operation of various subsystems.

20 Claims, 4 Drawing Sheets

PREDICTED CUTTING SPEEDS

| Thickness | Cut Speed mm/min | Cut Speed mm/min | PSI Nozzle Discharge Pressure | Material | Abrasive | Abrasive Concentration To Fluid |
|---|---|---|---|---|---|---|
| 5 mm | 295 | 415 | 10,000 | L-80 Steel Casing | Garnet | 18% |
| 10 mm | 145 | 205 | 10,000 | L-80 Steel Casing | Garnet | 18% |
| 15 mm | 95 | 135 | 10,000 | L-80 Steel Casing | Garnet | 18% |
| 20 mm | 70 | 100 | 10,000 | L-80 Steel Casing | Garnet | 18% |

METHOD AND APPARATUS FOR JET-FLUID ABRASIVE CUTTING

CROSS REFERENCE TO RELATED APPLICATIONS

This application is a continuation of U.S. patent application Ser. No. 10/592,560, filed Sep. 13, 2006, entitled "METHOD AND APPARATUS FOR JET-FLUID ABRASIVE CUTTING," which is a national stage entry of PCT/US05/41017 filed Nov. 14, 2005 entitled, "METHOD AND APPARATUS FOR JET-FLUID ABRASIVE CUTTING," which claims the benefit of priority to U.S. Provisional Patent Application No. 60/627,308 filed Nov. 12, 2004, all of which are hereby fully incorporated by reference.

FIELD

The present disclosure relates to drilling and cutting systems and their methods of operation and, more particularly, to a method and apparatus for jet-fluid abrasive cutting.

BACKGROUND OF THE DISCLOSURE

This disclosure relates to the cutting of computer programmed shape and window profile(s) through a well bore casing whose inside diameter is three inches or larger, and more particularly, to the controlled and precise use of an abrasive-jet-fluid to cut a predefined shape or window through a well bore casing, thereby facilitating and providing access to the formation structure beyond the cemented casing.

Many wells today have a deviated bore drilled extending away from a generally vertical axis main well bore. The drilling of such a side-track is accomplished via multiple steps. After casing and cementing a well bore, historically a multi-stage milling process is employed to laterally cut a window through the casing at the general location where it is desired to start the side-track. Once the window is milled open, the drilling process may begin.

Although simple in concept, the execution is often complicated and difficult to achieve in a timely fashion. Several complicating factors are that the well bore casing is made of steel or similarly hard material as well as the casing is difficult to access down the well bore hole. Historically it is not uncommon to take 10 hours to complete the milling of the desired shape and/or window profile(s) through the casing using conventional machining processes. An improper shape or window profile(s) of the side-track hole cut through the steel casing may cause drill breakage during a horizontal or lateral drilling procedure.

A prior art method and apparatus for cutting round perforations and elongated slots in well flow conductors was offered in U.S. Pat. No. 4,134,453, which is hereby incorporated by reference as if fully set forth herein. The disclosed apparatus has jet nozzles in a jet nozzle head for discharging a fluid to cut the perforations and slots. A deficiency in this prior art method is that the length of the cuts that the disclosed jet nozzle makes into the rock formation is limited because the jet nozzle is stationary with respect to the jet nozzle head.

Another prior art method and apparatus for cutting panel shaped openings is disclosed in U.S. Pat. No. 4,479,541, which is hereby incorporated by reference as if fully set forth herein. The disclosed apparatus is a perforator having two expandable arms. Each arm having an end with a perforating jet disposed at its distal end with a cutting jet emitting a jet stream. The cutting function is disclosed as being accomplished by longitudinally oscillating, or reciprocating, the perforator. By a sequence of excursions up and down within a particular well segment, a deep slot is claimed to be formed.

The offered method is deficient in that only an upward motion along a well bore is possible due to the design of the expandable arms. Furthermore, the prior art reference does not provide guidance as how to overcome the problem of the two expandable arms being set against the well bore wall from preventing motion in a downward direction. A result of the prior art design deficiency is that sharp angles are formed between the well wall, thereby causing the jet streams emitted at the jets at the distal ends of the expandable arms to only cut small scratches into the well bore walls.

A further prior art method and apparatus for cutting slots in a well bore casing is disclosed in U.S. Pat. No. 5,445,220, which is hereby incorporated by reference as if fully set forth herein. In the disclosed apparatus a perforator is comprised of a telescopic and a double jet nozzle means for cutting slots. The perforator centered about the longitudinal axis of the well bore during the slot cutting operation.

The perforator employs a stabilizer means, which restricts the perforator, thus not allowing any rotational movement of the perforator, except to a vertical up and down motion. Additionally, the lifting means of the perforator was not shown or described.

An additional prior art method and apparatus for cutting casing and piles is disclosed in U.S. Pat. No. 5,381,631, which is hereby incorporated by reference as if fully set forth herein. The disclosed apparatus provides for a rotational movement in a substantially horizontal plane to produce a circumferential cut into the well bore casing. The apparatus drive mechanism is disposed down hole at the location near the cut target area. The prior art reference is deficient in that the apparatus requires multi-hoses to be connected from the surface to the apparatus for power and control.

There is a need, therefore, for a method and apparatus of cutting precise shape and window profile(s), which can be accomplished more quickly and less expensively. An additional need is to perforate casings, cut pilings below the ocean floor and to slot well bore casings using the unique programmed movement of a jetting-shoe.

SUMMARY OF THE DISCLOSURE

The present disclosure has been made in view of the above circumstances and has as an aspect a down hole jet-fluid cutting apparatus capable of cutting a shape or profile window into a well-bore casing by the application of coherent high pressure abrasive fluid mixture.

The present disclosure solves the here aforementioned problems by employing the use of a computer, central processing unit or microchip controlled independent rotational and longitudinal movements of a jetting-shoe down in the bore hole to cut predefined shapes and window profile(s) into and through the well bore casing being driven by two or more servo driven units attached at the surface on the wellhead. After the shape or window profile(s) are precisely cut, using the teachings of the present disclosure, drilling of the side-track can commence.

To achieve these and other advantages and in accordance with the purpose of the present disclosure, as embodied and broadly described, the present disclosure can be characterized according to one aspect of the present disclosure as comprising a down hole jet-fluid cutting apparatus, the apparatus including a jet-fluid nozzle and a high pressure pump, wherein the high pressure pump is capable of delivering a fluid abrasive mixture at high pressure to the jet-fluid nozzle. An abrasive fluid mixing unit, wherein the abrasive fluid mixing unit is capable of maintaining a coherent abrasive fluid mixture and a high pressure conduit for delivering the coherent high pressure jet-fluid abrasive mixture to the jet-fluid nozzle.

A jet-fluid nozzle jetting shoe is employed, wherein the jetting shoe is adapted to receive the jet-fluid nozzle and direct the coherent high pressure jet-fluid abrasive mixture towards a work piece, wherein the jetting shoe controlling unit further includes at least one servomotor for manipulating the tubing and the jetting shoe along a vertical and horizontal axis.

A central processing unit having a memory unit, wherein the memory unit is capable of storing profile generation data for cutting a predefined shape or window profile in the work piece. The central processing unit further includes software, wherein the software is capable of directing the central processing unit to perform the steps of: controlling the jetting shoe control unit to manipulate the jetting shoe along the vertical and horizontal axis to cut a predefined shape or window profile in the work piece. The jetting shoe control unit controls speed feed and the vertical and horizontal axial movement of the tubing and jetting shoe to cut a predefined shape or window profile in the work piece. The software controls the percentage of the abrasive fluid mixture to total fluid volume and also controls pressure and flow rates of the high pressure pump.

The present disclosure can be further characterized according to one aspect of the present disclosure as a method for computer assisted milling of a well-bore structure, the method comprising the steps of setting a bottom trip anchor into a well-bore at a predetermined depth below a milling site and inserting into the well-bore a directional gyro, wherein the directional gyro is positioned such that it rests on top of the inserted bottom trip anchor.

Transmitting directional telemetry from the directional gyro regarding the position of the bottom trip anchor to an above ground computer and retrieving the inserted directional gyro. Coupling a profile generation system onto at least one of the well-bore well head or a blow out preventor stack and creating a communication link with the computer and connecting the computer to a two axis servo drive. Inserting a jetting-shoe assembly via a tubing string into an annulus of the well bore casing to the milling site depth and attaching rotating centralizers on an outer diameter surface of the tubing string to center the tubing string in the annulus. Milling of the site via an abrasive-jet fluid from the jetting-shoe assembly is performed, wherein the computer implements a predefined shape or window profile at the milling site by controlling the vertical movement and horizontal movement through a 360 degree angle of rotation of the jetting-shoe assembly.

It is to be understood that both the foregoing general description and the following detailed description are exemplary and explanatory only and are not restrictive of the disclosure, as claimed.

BRIEF DESCRIPTION OF THE DRAWINGS

The accompanying drawings, which are incorporated in and constitute a part of this specification, illustrate embodiments of the disclosure and together with the description, serve to explain the principles of the disclosure.

DETAILED DESCRIPTION OF THE DISCLOSURE

Figure 1:
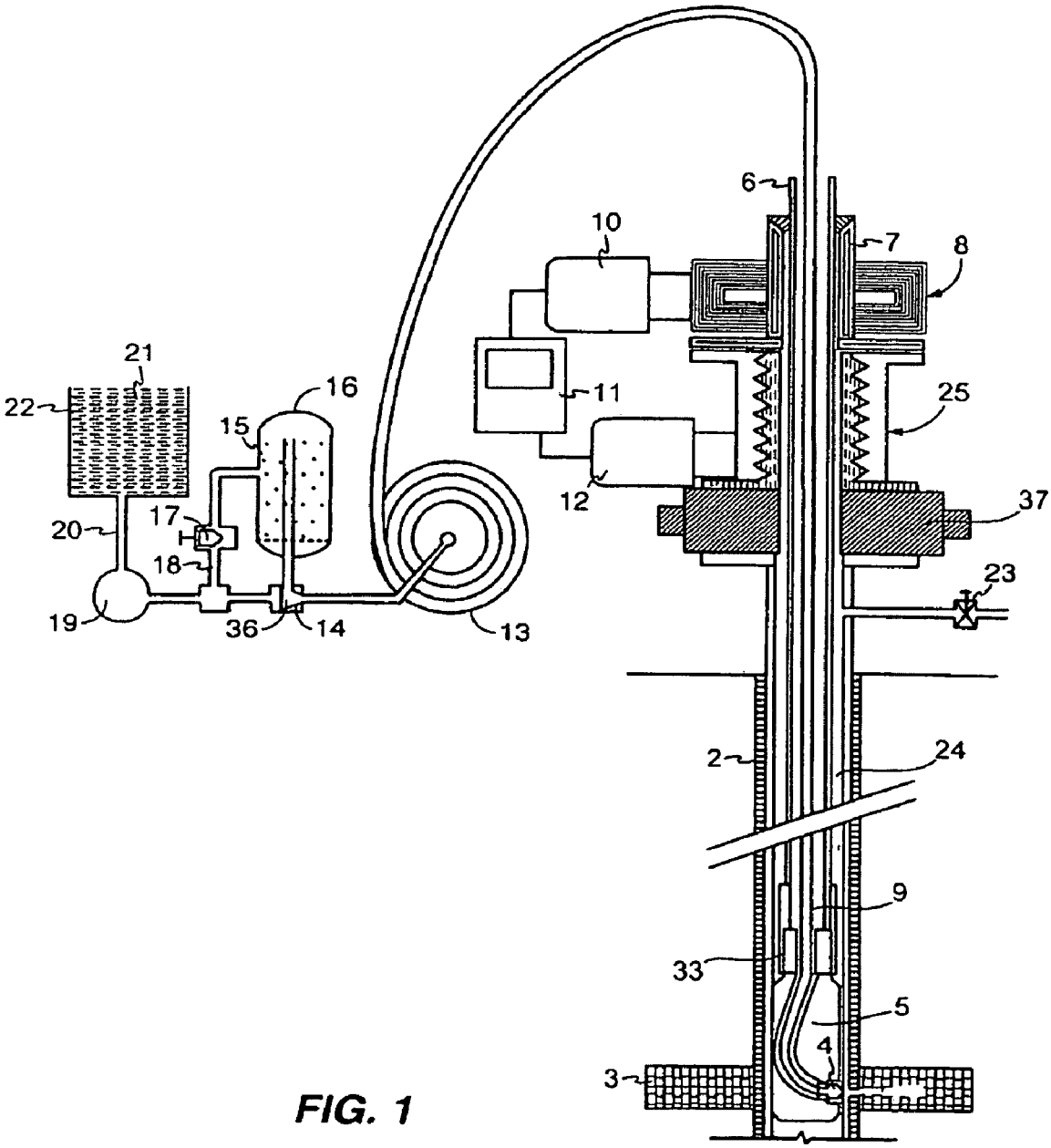
FIG. 1 is a two dimensional cutaway view showing an embodiment of the programmable abrasive-jet-fluid cutting system of the present disclosure.

Reference will now be made in detail to the present embodiments of the disclosure, examples of which are illustrated in the accompanying drawings. Wherever possible, the same reference numbers will be used throughout the drawings to refer to the same or like parts (elements).

To help understand the advantages of this disclosure the accompanying drawings will be described with additional specificity and detail.

The present disclosure generally relates to methods and apparatus of abrasive-jet-fluid cutting through a well bore casing or similar structure. The method generally is comprised of the steps of positioning a jetting-shoe and jet-nozzle adjacent to a pre-selected portion of a length of casing in the annulus, pumping fluid containing abrasives through the jetting-shoe and attached jet-nozzle such that the fluid is jetted there from, moving the jetting-shoe and jet-nozzle in a predetermined programmed vertical axis and 360 degree horizontal rotary axis.

In one embodiment of the present disclosure the vertical and horizontal movement pattern(s) are capable of being performed independently of each or programmed and operated simultaneously. The abrasive-jet-fluid there from is directed and coordinated such that the predetermined pattern is cut through the inner surface of the casing to form a shape or window profile(s), allowing access to the formation beyond the casing.

A profile generation system simultaneously moves a jetting-shoe in a vertical axis and 360-degree horizontal rotary axis to allow cutting the casing, cement, and formation rock, in any programmed shape or window profile(s). A coiled tubing for delivering a coherent high pressure abrasive-jet-fluid through a single tube and a jet-nozzle for ejecting there from abrasive-jet-fluid under high pressure from a jetting-shoe is contemplated and taught by the present disclosure.

The jetting-shoe apparatus and means are programmable to simultaneously or independently provide vertical axis and 360-degree horizontal rotary axis movement under computer control. A computer having a memory and operating pursuant to attendant software, stores shape or window profile(s) templates for cutting and is also capable of accepting inputs via a graphical user interface, thereby providing a system to program new shape or window profile(s) based on user criteria. The memory of the computer can be one or more of but not limited to RAM memory, flash memory, ROM memory, EPROM memory, EEPROM memory, registers, hard disk, a removable disk, a CD-ROM, floppy disk, DVD-R, CD-R disk or any other form of storage medium known in the art. In the alternative, the storage medium may be integral to the processor. The processor and the storage medium may reside in an ASIC or microchip.

The computer of the present disclosure controls the profile generation servo drive systems as well as the abrasive mixture percentage to total fluid volume and further controls the pressure and flow rates of a high pressure pump and pump drive. The computer further controls the feed and speed of the coiled tubing unit and the coiled tubing injector head and the simultaneous jacking and the directional rotation of the tubing in an annulus. Telemetry is broadcast and transmitted after scanning of the cut shape or window profile(s) after the casing has been cut by a sensor or probe located in proximity to the jet-nozzle head.

In an alternate embodiment of the present disclosure the abrasive-jet-fluid method and apparatus is capable of cutting into the underlying substructure, such as rock or sediment.

In a further embodiment of the present disclosure the cutting apparatus can be directed to cut or disperse impediments in found or lodged in the well bore casing. Impediments such as measuring equipment, extraction tools, drill heads or pieces of drill heads and various other equipment utilized in the industry and readily recognizable by one skilled in the art, periodically become lodged in the well bore and must be removed before work at the site can continue.

In a still further embodiment multiple jet heads can be employed to form simultaneous shapes or window profiles in the well bore casing or underlying substructure as the application requires. This type of application, as appreciated by one skilled in the art, can be employed to disperse impediments in the well bore or to severe the well bore casing at a desired location so that it can be extracted. Additionally, this embodiment can be employed where a rock formation or other sub-structure is desired to be shaped symmetrically or asymmetrically to assist in various associated tasks inherent to the drilling or extraction process.

In a still further embodiment of the present disclosure the vertical axis of the cutting apparatus is capable of being manipulated off the plane axis to assist in applications wherein the well bore is not vertical, as is the case when directional drilling is employed.

In one embodiment of the present disclosure, the jetting-shoe is attached to a tubing string and suspended at the wellhead and is moved by the computer, (Bill is this covered in the claims about not having to use the coiled tubing to deliver the high pressure as we are to build a rig that uses the tubing string also as the fluid tube with no coiled tubing unit?) central processing unit or micro-chip (hereinafter collectively called the computer) controlled servo driven units. Software in communication with sub-programs gathering telemetry from the site directs the computer, which in turns communicates with and monitors the down hole cutting apparatus and its attendant components, and provides guidance and direction simultaneously or independently along the vertical axis and the horizontal axis (360-degrees of movement) of the tubing string via servo driven units.

The shape or window profile(s) that are desired is programmed by the operator on a program logic controller (PLC), or personal computer (PC), or a computer system designed for this specific use. The integrated software via a graphical user interface (GUI) accepts inputs from the operator and provides the working parameters and environment by which the computer directs and monitors the cutting apparatus.

The rotational computer controlled axis servo motor, such as a Fanuc model D2100/150is servo, provides 360-degree horizontal rotational movement of the tubing string using a tubing rotator such as R and M Energy Systems heavy duty model RODEC RDII, or others, that have been modified to accept a mechanical connection for the servo drive motor. The tubing rotator supports and rotates the tubing string up to 128,000 pounds. Heavier capacity tubing rotators may be used if necessary as will be apparent to those skilled in the art.

The vertical axis longitudinal computer controlled servo axis motor, such as Fanuc D2100/150is servo, provides up and down vertical movement of the tubing string using a jack assembly attached to the top of the wellhead driven by said servo drive motor. The jack preferable will use ball screw(s) for the ease of the vertical axis longitudinal movements, although other methods may be employed. The jack typically will be adapted for use with 10,000-PSI wellhead pressures, although the present disclosure is by no means limited to wellhead pressures below or above 10,000-PSI. The jack typically will have means for a counter balance to off set the weight of the tubing string to enhance the life of the servo lifting screw(s) or other lifting devices such as Joyce/Dayton model WJT 325WJ3275 screw jack(s).

The servos simultaneously drive the tubing rotator and jack, providing vertical axis and 360-degree horizontal rotary axis movement of the tubing string attached to the down-hole jetting-shoe. The shape or window profile(s) cutting of the casing is thus accomplished by motion of the down hole jetting-shoe and the abrasive-jet-fluid jetting from the jet-nozzle into and through the casing, cement, tools, equipment and/or formations.

The abrasive-jet-fluid in one embodiment of the present disclosure is delivered by a coiled tubing unit through a fluid-tube to the jetting-shoe through the inner bore of the tubing string, or the abrasive-jet-fluid can be pumped directly through the tubing string, with the jet-nozzle being attached to the exit of the jetting-shoe.

The abrasive-jet-fluid jet-nozzle relative position to the casing is not critical due to the coherent stream of the abrasive-jet-fluid. The jet-nozzle angle nominally is disposed at approximately 90 degrees to the inner well bore surface, impediment or formation to be cut, but may be positioned at various angles in the jetting-shoe for tapering the entry hole into the casing and formation by the use of different angles where the jet-nozzle exits the jetting-shoe. Empirical tests have shown that employing 10,000-PSI and a 0.7 mm nozzle orifice with 1.9 gallons per minute of the coherent abrasive jet fluid, is sufficient to cut through a steel well bore casing and multi cemented conductors in a reasonable period of time.

In an alternate embodiment, empirical tests have shown that fluid pressure below 10,000 PSI with varying orifice sizes and water flow rates will provide sufficient energy and abrasion to cut through the well bore casing or formation, but at a cost of additional time to complete the project. As will be appreciated by those skilled in the art, variations in the nozzle orifice size or the abrasive component utilized in the cutting apparatus fluid slurry will generally necessitate an increase or decrease in the fluid slurry flow rate as well as an increase or decrease in the pressure required to be applied to the coherent abrasive-jet fluid (slurry). Additionally, the time constraints attendant to the specific application will also impinge upon the slurry flow rate, pressure and orifice size select the specific application undertaken.

One advantage of the present disclosure over the prior art is that the attendant costs of cutting through the well bore casing or formation will be relatively nominal as compared to the total drilling costs. In addition, the present disclosure provides that any additional costs of operation of the cutting apparatus may be significantly offset by the decreased site and personnel down time.

The methods and systems described herein are not limited to specific sizes or shapes. Numerous objects and advantages of the disclosure will become apparent as the following detailed description of the multiple embodiments of the apparatus and methods of the present are depicted in conjunction with the drawings and examples, which illustrate such embodiments.

In an alternate embodiment of the present disclosure, a method for cutting user programmable shapes or window profile(s) through down hole casing, cement, and formation rock using abrasive-jet-fluid flowing from a jet-nozzle includes an electric line unit inserted into the annulus. The electric line unit is operated topside and is keyed to a bottom trip anchor at a predetermined depth, which is a known distance below the bottom elevation depth where the shape or window profile(s) are to be cut. The bottom trip anchor is anchored to the well-bore casing and the electric line is removed and an electrical line operated directional gyro is inserted into the annulus.

The directional gyro is seated onto the top keyed bottom trip anchor, so the direction of the top key is known at the surface and this information is inputted into the surface computer, which controls the directional reference of the top keyed bottom trip anchor as well as two axis drive servos. The directional gyro is then removed from the annulus and a profile generation system is secured onto the well head or on top of a blow out preventor stack.

A work-over-rig or a drill rig is then utilized to attach a jetting-shoe to the end of a tubing string, which are inserted into the annulus of the cased well bore to a point down hole in the annulus, where a user programmable shape or window profile(s) are to be abrasive-jet-fluid cut through the casing and cement, to expose formation rock. Rotating centralizers on the O.D. of the tubing string are employed to keep the tubing string centered in the annulus as further feeding of jetting-shoe onto the top keyed bottom trip anchor is commenced if a specific rotational direction is required.

The jetting-shoe rotational direction is then established and data is inputted into the surface computer regarding the known depth established by the placement of the jetting-shoe onto the top keyed bottom trip anchor. The tubing string is then sufficient to allow setting air or other slips around the tubing string in the tubing rotator to suspend and hold the tubing string. Thus, allowing the shape or window profile generation system to be able to simultaneously move the vertical axis and 360 degree horizontal rotary axis of the tubing string under computer program control, after moving the jetting-shoe off of the top keyed bottom trip anchor.

The method for cutting user programmable shapes or window profile(s) through down hole casing further includes inserting a fluid-tube, that is fed from a coiled tubing unit and tubing injector head, into the bore of the tubing string which is suspended by the rotator and jack of the profile generation system, so the jet-nozzle attached to the end of the fluid-tube is fed through the jetting-shoe to face the inner surface of the casing.

An operational cycle of the computer control unit is then commenced, which positions the jetting-shoe and jet-nozzle into the proper location for cutting the user programmable shapes or window profile(s), which in turns engages the high pressure pump and drives the two-axis programmable computer servo controller unit at the surface to generate the user programmable shape or window profile(s) to cut through the casing or through a plurality of metal casing of varying diameters stacked within each other and sealed together with concrete grout.

The computer further controls the coiled tube unit and the feed speed of the tubing injector and depth location of the jet-nozzle attached to the end of the fluid-tube. A coordinate measuring of the cut shapes or window profile(s) is performed by scanning with a magnetic proximity switch on the jetting-shoe that faces the inner surface of the annulus. The cutting apparatus and its attendant components are rotated and raised and lowered by the profile generation system under computer control.

The magnetic proximity switch senses the casing in place, or the casing that has been removed by the abrasive-jet-fluid, and activates a battery operated sonic transmitter mounted in the jetting-shoe, which transmits a signal to a surface receiver, that is coupled to the computer control unit containing the data of the originally programmed casing cut shapes or window profile(s) for comparison to the user programmed shape or window profile(s).

FIG. 1 depicts a well bore lined with a casing 1. Casing 1 is typically cemented in the well bore by cement bond 2, wherein cement bond 2 is surrounded by a formation 3. A jetting-shoe 5 is illustrated in FIG. 1 with a jet nozzle 4 attached to the end of fluid-tube 9. The jetting shoe 5 is depicted with a threaded joint 33 attached at a lower end of a string of drill or tubing string 6. Drill or tubing string 6 and jetting shoe 5 are lowered into annulus 24 of the well at or near a location where a shape or window profile(s) is to be cut and is suspended by tubular adaptor flange 7 in by tubing rotator 8.

FIG. 1 further depicts jetting shoe 5 in position with a fluid-tube 9 being fed into the drill or tubing string 6 by a coil tubing injector head (not shown) from a coil tubing reel 13 through the jetting-shoe 5. The fluid-tube 9 is transitioned from a vertical to horizontal orientation inside of the jetting-shoe 5 such that the jet-nozzle 4 is in disposed in proximity to casing 1 that is to be cut. The reader should note, that although the drawings depict a well casing being cut into, that the work piece could very well be an impediment such as a extraction tool or other equipment lodged in the casing.

The shape or window profile(s) are programmed into the computer 11 via a graphical user interface (GUI) and the high-pressure pump 19 is initiated when the operator executes the run program (not shown) on the computer 11. The computer 11 is directed by sub-programs and parameters inputted into the system by the user. Additionally, previous cutting sessions can be stored on the computer 11 via memory or on a computer readable medium and executed at various job sites where the attendant conditions are such that a previously implement setup is applicable.

Fluid 21 to be pumped is contained in tank 22 and flows to a high pressure pump 19 through pipe 20. The high pressure pump 19 increases pressure and part of the fluid flows from the high pressure pump 19 is diverted to flow pipe 18 and then into fluid slurry control valve 17 and into abrasive pressure vessel 16 containing abrasive material 15. Typically a 10% flow rate is directed via flow pipe 18 and fluid slurry control valve 17 to the abrasive pressure vessel 16. The flow rate is capable of being adjusted such that the abrasive will remain suspended in the fluid 21 utilized. In examples of predictive cutting times, the base line flow was modulated to provide an abrasive concentration to fluid of 18%. The maintaining of an abrasive to concentration fluid ratio is an important element in the present disclosure as well as the type of abrasive, such as sand, Garnet, various silica, copper slag, synthetic materials or Corundum are employed.

The volume of fluid directed to the abrasive pressure vessel 16 is such that a fluid, often water, and abrasive slurry are maintained at a sufficient velocity, such as 2.4 to 10 meters per second through fluid-tube 9, so that the abrasive is kept in suspension through the jet-nozzle 4. A velocity too low will result in the abrasive falling out of the slurry mix and clumping up at some point, prior to exiting the jet-nozzle 4. This ultimately results in less energy being delivered by the slurry at the target site.

Furthermore, a velocity too high will result in similarly deleterious effects with respect to the energy being delivered by the slurry at the target site. As will be appreciated by one skilled in the art, the application of the present disclosure uses up or renders inoperable some of the equipment employed in the cutting process. For instance if the slurry mix is not properly maintained or the abrasive material 15 is not of a uniform grade or resiliency to perform adequately, the jet nozzle 4 and jet-nozzle orifice may be consumed at a faster rate than normal, ultimately resulting in additional down time, costs and expense.

The abrasive material 15, such as sand garnet or silica, is mixed with the high pressure pump 19 fluid flow at mixing valve 14. Mixing valve 14 further includes a ventura 36, which produces a jet effect, thereby creating a vacuum aid in drawing the abrasive water (slurry) mix. With the above-described orientation the slurry exiting the jet-nozzle 4 can achieve multiples of supersonic speeds and be capable of cutting through practically any structure or material.

The coherent abrasive-jet-fluid then flows through coiled tubing reel 13 and down fluid-tube 9 and out jet-nozzle 4 cutting the casing 1 and the cement bond 2 and the formation 3. Although, the drawings and examples refer to cutting or making a shape or window profile in the well bore casing, it should be understood by the reader that the present disclosure is not limited to this embodiment an application alone, but is applicable and contemplated by the inventors to be utilized with regard to impediments and other structures as described above.

In an alternate embodiment an abrasive with the properties within or similar to the complex family of silicate minerals such as garnet is utilized. Garnets are a complex family of silicate minerals with similar structures and a wide range of chemical compositions, and properties. The general chemical formula for garnet is AB(SiO), where A can be calcium, magnesium, ferrous iron or manganese; and B can be aluminum, chromium, ferric iron, or titanium.

More specifically the garnet group of minerals shows crystals with a habit of rhombic dodecahedrons and trapezohedrons. They are nesosilicates with the same general formula, A3B2(SiO4)3. Garnets show no cleavage and a dodecahedral parting. Fracture is conchoidal to uneven; some varieties are very tough and are valuable for abrasive purposes. Hardness is approximately 6.5-9.0 Mohs; specific gravity is approximately 3.1-4.3.

Garnets tend to be inert and resist gradation and are excellent choices for an abrasive. Garnets can be industrially obtained quite easily in various grades. In the present disclosure, empirical tests performed utilized an 80 grit garnet with achieved superior results.

A person of ordinary skill in the art will appreciate that the abrasive material 15 is an important consideration in the cutting process and the application of the proper abrasive with the superior apparatus and method of the present disclosure provides a substantial improvement over the prior art.

The cutting time (see FIG. 4) of the abrasive-jet-fluid is dependent on the material and the thickness cut. The computer 11 processes input data and telemetry and directs signals to the servomotor 10 and servomotor 12 to simultaneously move tubing rotator 8 and tubing jack 25 to cut the shapes or window profile(s) that has been programmed into the computer 11. Predetermined feed and speed subprograms are incorporated into the software to be executed by computer 11 in the direction and operation of the cutting apparatus.

Any excess fluid is discharged up annulus 24 through choke 23. The steel that is cut during the shaping or cutting process drops below the jetting shoe 5 and can be caught in a basket (not shown) hanging below or be retrieved by a magnet (not shown) attached to the bottom of the jetting shoe 5 if required.

Figure 2:
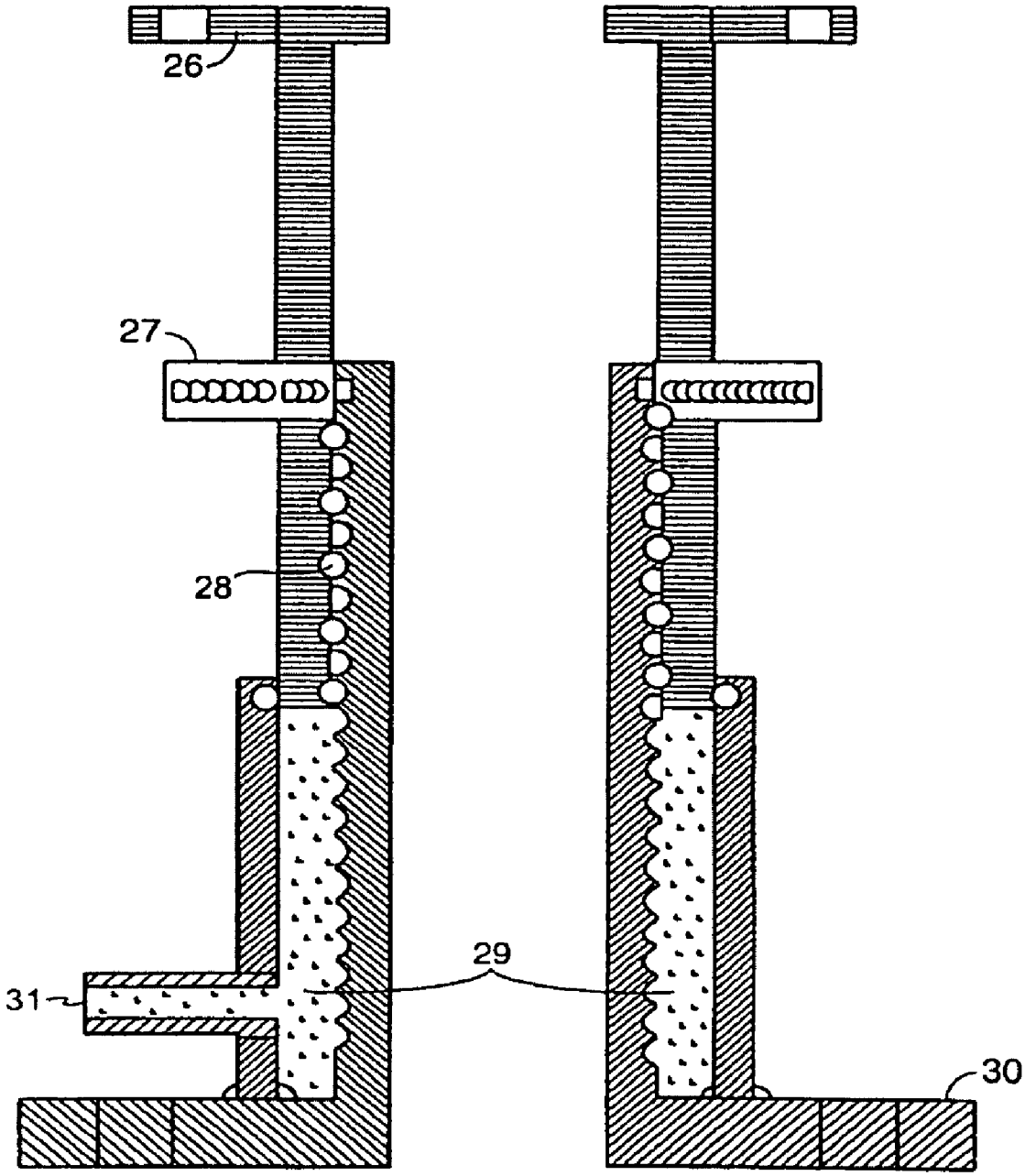
FIG. 2 is a two dimensional cutaway view depicting an embodiment of the jack of the present disclosure.

Tubing jack 25 is driven in the vertical axis by a worm gear 27, depicted in FIG. 2, which is powered by a servo motor (not shown) that drives a ball screw 28. The tubing jack 25 is bolted on the well-head 37 at flange 30. The tubing jack 25 is counterbalanced by the hydraulic fluid 29 that is under pressure from a hydraulic accumulator cylinder under high pressure 31. The rotator is attached on the top of the tubing jack 25 at flange 26.

Figures 3, 4:
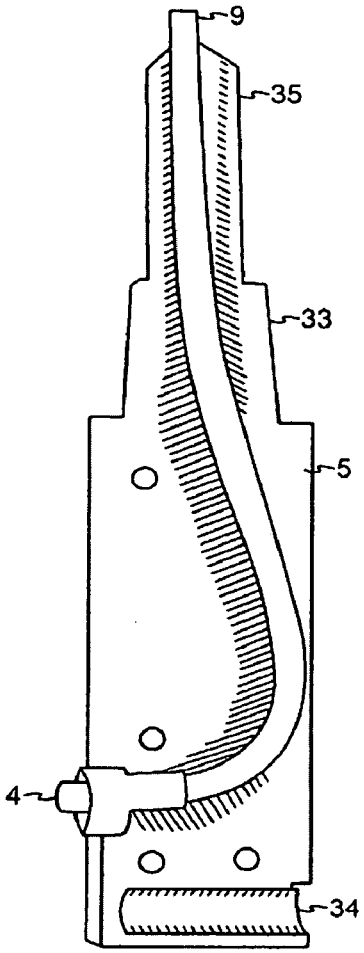
FIG. 3 is a three-dimensional cutaway view of an embodiment of a jetting-shoe of the present disclosure.
FIG. 4 is a table depicting predictive cutting speed employing various nozzle sizes of the present disclosure.

The jetting shoe 5, as illustrated in FIG. 3, is typically made of 4140-grade steel or similarly resilient material and heat treated to Rockwell 52 standard. The jetting-shoe 5 is connected to the tubing string 6 with threads 33. Stabbing guide 35, a part of the jetting-shoe 5, is disposed inside of tubing string 6 that supports the guiding of the flow-tube 9 into the jetting shoe 5. The flow-tube 9 transitions from a vertical axis to a horizontal axis inside of the jetting-shoe 5. The jet-nozzle 4 is coupled to the fluid-tube 9 and disposed such that it faces the surface face of the well-bore casing and the coherent abrasive-jet-fluid exits the jet-nozzle 4 and cuts the casing 1.

A battery operated sonic transmitter and magnetic proximity switch, not shown, are installed in bore-hole 34 of the jetting-shoe 5 to allow scanning of the abrasive-jet-fluid cuts through the casing 1. Telemetry is transmitted via a signaling cable to computer 11. The signaling cable, not shown, may be of a shielded variety or optical in nature, depending on the design constraints employed.

FIG. 4 depicts a table of predicted cutting speeds, based on a 10,000-PSI pressure delivered to the jet-nozzle 4 comprising either a 0.5 mm or 0.7 mm orifice. The nozzle 4 is made of 416 heat-treated stainless steel or similarly resilient material and has either a carbide or sapphire orifice such as a NLB Corp model SA designed for abrasive-jet-fluids. A person of ordinary skill in the art will appreciate that the table is illustrative only of the disclosure and is intended to give the reader a generally knowledge of the predictive cutting times.

The present disclosure is by no means limited to the pressures and jet nozzle constraints depicted in the table of FIG. 4. The jet-nozzle 4 and the jet-nozzle orifice are capable of being made of a multitude of competing and complimentary materials, that are contemplated and taught by this application, that yield outstanding results and substantial improvements over the prior art.

Furthermore, a person of ordinary skill in the art will appreciate that each job site will present different and sometimes unique problems to be solved and that the examples in the table of FIG. 4 will necessarily change to meet the needs and constraints attendant.

For instances, the casing material to be cut is a variable, as well as the diameter of the casing. In one instance the diameter of the casing could be 12" and another 4". Additionally, the depth of the cutting or shaping site will vary and if the predicted pressure loss is 0.5 lbs/ft the resultant pressure at the jet-nozzle may be lower than the examples in the predictive cutting table of FIG. 4.

Based on these constraints and many others, the cutting times desired, cutting rate attainable, nozzle size orifice, abrasive material on hand or selected, pressure to be delivered at the work site, as well as safety concerns and the depletion of the equipment deployed are incorporated into the final calculations and either programmed or inputted into the computer 11.

Additional empirical tests have demonstrated that in one embodiment of the present disclosure the operational range contemplated is between approximately 5000 and 40,000 PSI with a nominal working range of approximately 17,400-PSI.

Figure 5B:
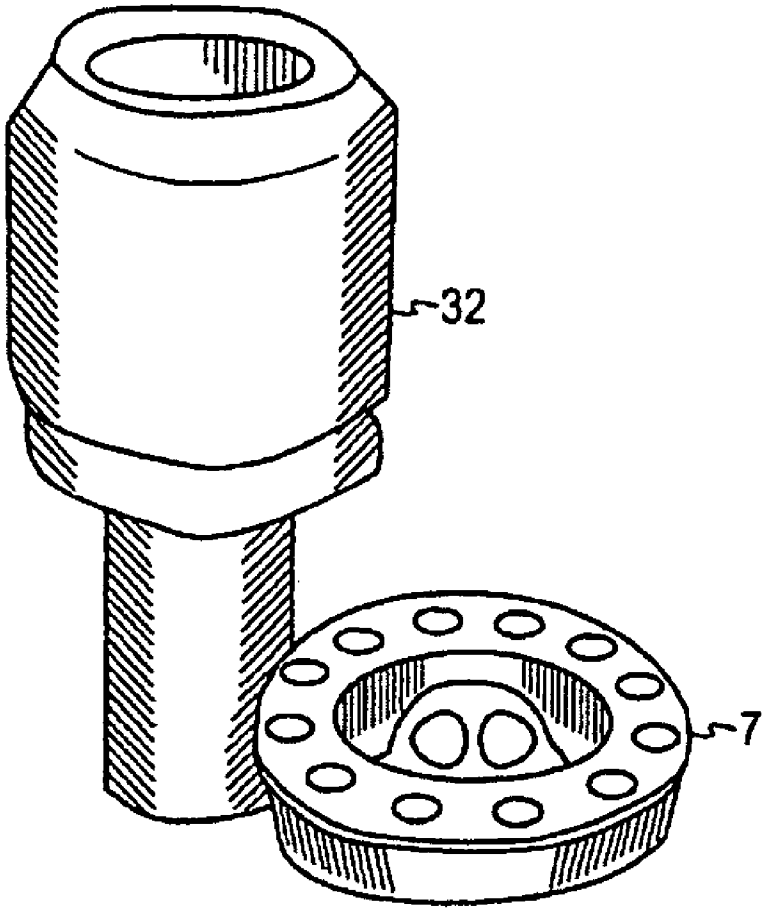
FIGS. 5A and 5B is a depiction of a three dimensional cutaway view of a rotator of the present disclosure.
Figure 5A:
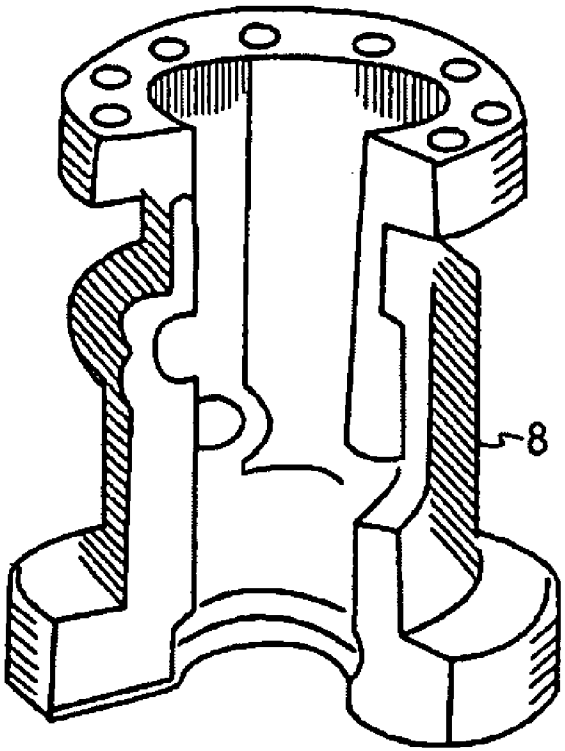

FIGS. 5A and 5B depicts a rotator casing bowl 8, such as R and M Energy Systems heavy duty model RODEC RDII, secured on top of tubing jack 25. The tubing string 6 is inserted through (see FIG. 5B) tubular adaptor flange 7, which is further disposed on top of pinion shaft 32. Pinion shaft 32 is adapted to secure and suspend the tubing string 6 within the annulus 24. The 360-degree rotary movement of the tubing string 6 is accomplished by the pinion shaft 32, which is powered by servomotor 10. The present disclosure may be embodied in other specific forms without departing from its spirit or essential characteristics.

The described embodiments are to be considered in all respects only as illustrative and not restrictive. It will be apparent to those skilled in the art that various modifications and variations can be made in the Method and Apparatus for Jet-Fluid Cutting of the present disclosure and in construction of this disclosure without departing from the scope or intent of the disclosure.

Other embodiments of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

What is claimed is:

1. Apparatus for cutting shape or window profile(s) through casing, cement and formation rock using abrasive-jet-fluid flowing through a jet-nozzle, the apparatus comprising:

a profile generation system which simultaneously directs the movements of a tubing string in a vertical axis and 360 degree horizontal rotary axis via servo drives to allow cutting of at least one of a casing, cement or formation rock, in any programmed shape or window profile(s);

a jetting shoe coupled to the tubing string;

a magnetic proximity switch coupled to the jetting shoe;

coiled fluid tubing for delivering a coherent high pressure abrasive-jet-fluid through a single tube;

a jet-nozzle for ejecting an abrasive-jet-fluid under high pressure from the jetting-shoe; and the profile generation system is capable of:

storing shape or window profile(s) templates for cutting a shape or window profile in at least one of a casing;

accepting user input to program new shape or window profile(s) based on user criteria;

controlling the profile generation servo drives;

controlling an abrasive mixture percent to total fluid volume;

controlling the pressure and flow rates of a high pressure pump and drive;

controlling feed and speed of a coiled fluid tubing unit and a coiled tubing injector head, controlling the simultaneous vertical and horizontal directional movements of the coiled tubing, scanning the cut shape or window profile(s) after the casing, cement or rock formation has been cut.

2. The apparatus according to claim 1, wherein the scanning is performed by the magnetic proximity switch.

3. The apparatus according to claim 2, additionally comprising a battery operated sonic transmitter.

4. The apparatus according to claim 3, wherein the battery operated sonic transmitter is capable of transmitting a signal from the magnetic proximity switch to a surface receiver coupled to the computer control unit.

5. The apparatus according to claim 1, wherein the profile generation system is capable of performing the additional step of sensing the casing in place or absence of the casing.

6. The apparatus according to claim 5, wherein the magnetic proximity switch is used to sense the casing.

7. The apparatus according to claim 6, additionally comprising a battery operated sonic transmitter.

8. The apparatus according to claim 7, wherein the battery operated sonic transmitter is capable of transmitting a signal from the magnetic proximity switch to a surface receiver coupled to the computer control unit.

9. The apparatus according to claim 6, wherein the magnetic proximity switch is used to scan the cut shape or window profile.

10. The apparatus according to claim 9, additionally comprising a battery operated sonic transmitter capable of transmitting a signal from the magnetic proximity switch to a surface receiver coupled to the computer control unit.

11. The apparatus according to claim 10, wherein the step of scanning of the cut shape or window profile includes measuring the co-ordinates of the cut shape or window profile.

12. A method for cutting shape or window profile(s) through casing, cement and formation rock using abrasive-jet-fluid flowing through a jet-nozzle, the method comprising the steps of:

directing the movements of a tubing string simultaneously in a vertical axis and 360 degree horizontal rotary axis via servo drives to allow cutting of at least one of a casing, cement or formation rock, in any programmed shape or window profile(s);

delivering a coherent high pressure abrasive-jet-fluid through a coiled fluid tube;

ejecting an abrasive-jet-fluid under high pressure from a jet-nozzle coupled to a jetting-shoe;

storing shape or window profile(s) templates for cutting a shape or window profile in at least one of a casing;

accepting user input to program new shape or window profile(s) based on user criteria;

controlling the servo drives;

controlling the abrasive-jet-fluid mixture percent to total fluid volume;

controlling the pressure and flow rates of a high pressure pump and drive;

controlling feed and speed of a coiled fluid tubing unit and a coiled tubing injector head, controlling the simultaneous vertical and horizontal directional movements of the coiled fluid tubing, scanning the cut shape or window profile(s) after the casing, cement or rock formation has been cut.

13. The method according to claim 12, wherein the scanning is performed by a magnetic proximity switch.

14. The method according to claim 13, further comprising an additional step of transmitting a signal from the magnetic proximity switch to a surface receiver via a battery operated sonic transmitter.

15. The method according to claim 12, further comprising an additional step of sensing the casing in place or absence of the casing.

16. The method according to claim 15, wherein the step of sensing the casing is performed by the magnetic proximity switch.

17. The method according to claim 16, further comprising an additional step of transmitting a signal from the magnetic proximity switch to a surface receiver via a battery operated sonic transmitter.

18. The method according to claim 16, wherein the step of sensing the casing includes scanning of the cut shape or window profile with the magnetic proximity switch.

19. The method according to claim 18, further comprising an additional step of transmitting a signal from the magnetic proximity switch to a surface receiver via a battery operated sonic transmitter.

20. The method according to claim 19, wherein the step of scanning of the cut shape or window profile includes measuring the co-ordinates of the cut shape or window profile.

* * * * *